United States Patent [19]

Kakizaki et al.

[11] Patent Number: 4,933,597

[45] Date of Patent: Jun. 12, 1990

[54] CATHODE RAY TUBE

[75] Inventors: Takehiro Kakizaki; Shoji Araki; Masatake Hayashi, all of Kanagawa, Japan

[73] Assignee: Sony Corporation, Tokyo, Japan

[21] Appl. No.: 423,368

[22] Filed: Oct. 19, 1989

Related U.S. Application Data

[63] Continuation of Ser. No. 700,955, Feb. 12, 1985, abandoned.

[30] Foreign Application Priority Data

Feb. 20, 1984 [JP] Japan ..... 59-30083

[51] Int. Cl.[5] ..... H01J 31/26

[52] U.S. Cl. ..... 313/450; 313/370; 313/460

[58] Field of Search ..... 313/383, 390, 450, 458, 313/460, 432, 439, 434, 370

[56] References Cited

U.S. PATENT DOCUMENTS 3,731,136 5/1973 Roussin ..... 313/434 X 3,890,529 6/1975 Hutter et al. ..... 313/460

3,922,580 11/1975 Hutter ..... 313/432 X

FOREIGN PATENT DOCUMENTS 54-121662 9/1979 Japan ..... 313/439

701032 12/1953 United Kingdom .

770047 3/1957 United Kingdom .

2156146 2/1985 United Kingdom .

*Primary Examiner*—Kenneth Wieder

*Attorney, Agent, or Firm*—Hill, Van Santen, Steadman & Simpson

[57] ABSTRACT

A cathode ray tube comprises an envelope, an electron beam source positioned at one end of the envelope, a target positioned at another end of the envelope, a first electrode supplied with low potential, and a second electrode supplied with high potential, the first and second electrodes being positioned between the electron beam source and the target, where extensions from the first electrode and extensions from the second electrode are combined with each other in zigzag form and intermediate potential is formed at intermediate position between the first electrode and the second electrode.

5 Claims, 9 Drawing Sheets

PRIOR APT

CATHODE RAY TUBE

This is a continuation of Ser. No. 700,955, filed Feb. 12, 1985, now abandoned.

BACKGROUND OF THE INVENTION

1. Field of the Invention

The present invention relates to a cathode ray tube which is preferably applied to an electrostatic focusing-/electrostatic deflection type image pickup tube for example.

2. Description of the Prior Art

The applicant of the present invention has previously proposed an image pickup tube of electrostatic focusing/electrostatic type (S·S type) as shown in FIG. 1 (Japanese pat. appln. No. 156167/83).

In FIG. 1, reference numeral 1 designates a glass bulb, numeral 2 a face plate, numeral 3 a target surface (photoelectric conversion surface), numeral 4 indium for cold sealing, numeral 5 a metal ring, and numeral 6 a signal taking metal electrode which passes through the face plate 2 and contacts with the target surface 3. A mesh electrode $G_6$ is mounted on a mesh holder 17. The electrode $G_6$ is connected to the metal ring 5 through the mesh holder 7 and the indium 4. Prescribed voltage, for example, +1200 V is applied to the mesh electrode $G_6$ through the metal ring 5.

Further in FIG. 1, symbols K, $G_1$ and $G_2$ designate a cathode to constitute an electron gun, a first grid electrode and a second electrode, respectively. Numeral 8 designates a bead glass to fix these electrodes. Symbol LA designates a beam limiting aperture.

Symbols $G_3$, $G_4$ and $G_5$ designate third, fourth and fifth grid electrodes, respectively. These electrodes $G_3$–$G_5$ are made in a process such that metal such as chromium or aluminium is evaporated or plated on the inner surface of the glass bulb 1 and then prescribed patterns are formed by cutting using a laser, photoetching or the like. These electrodes $G_3$, $G_4$ and $G_5$ constitute the focusing electrode system, and the electrode $G_4$ serves also for deflection.

A ceramic ring 11 with a conductive part 10 formed on its surface is sealed with frit 9 at an end of the glass bulb 1 and the electrode $G_5$ is connected to the conductive part 10. The conductive part 10 is formed by sintering silver paste, for example. Prescribed voltage, for example, +500 V is applied to the electrode $G_5$ through the ceramic ring 11.

The electrodes $G_3$ and $G_4$ are formed as clearly seen in a development of FIG. 2. To simplify the drawing, a part which is not coated with metal is shown by black line in FIG. 2. That is, the electrode $G_4$ is made of a so-called arrow pattern where four electrode portions $H_+$, $H_-$, $V_+$ and $V_-$, each insulated and zigzaged, are arranged alternately. In this case, each electrode portion is formed to extend in an angular range of 270°, for example. Leads ($12H_+$), ($12H_-$), ($12V_+$) and ($12V_-$) from the electrode portions $H_+$, $H_-$, $V_+$ and $V_-$ are formed on the inner surface of the glass bulb 1 simultaneously to the formation of the electrodes $G_3$–$G_5$ in similar manner. The leads ($12H_+$)–($12V_-$) are isolated from and formed across the electrode $G_3$ and in parallel to the envelope axis. Wide contact parts CT are formed at top end portions of the leads ($12H_+$)–($12_-$).

In FIG. 1, numeral 13 designates a contactor spring. One end of the contactor spring 13 is connected to a stem pin 14, and the other end thereof is contacted with the contact part CT of above-mentioned leads ($12H_+$)–($12_-$). The spring 13 and the stem pin 14 are provided for each of the leads ($12H_+$)–($12V_-$). The electrode portions $H_+$ and $H_-$ constitute the electrode $G_4$ through the stem pins, the springs and the leads ($12H_+$), ($12H_-$), ($12V_+$) and ($12V_-$) are supplied with prescribed voltage, for example, horizontal deflection voltage varying in symmetry with respect to 0V. Also the electrode portions $V_+$ and $V_-$ are supplied with prescribed voltage, for example, a vertical deflection voltage varying in symmetry with respect to 0V.

In FIG. 1, numeral 15 designates another contactor spring. One end of the contactor spring 15 is connected to a stem pin 16, and other end thereof is contacted with the above-mentioned electrode $G_3$. Prescribed voltage, for example, +500 V is applied to the electrode $G_3$ through the stem pin 16 and the spring 15.

Referring to FIG. 3*a*, equipotential surface of electrostatic lenses is formed by the electrodes $G_3$–$G_6$ and is represented by broken line, and the electron beam Bm is focused by such formed electrostatic lenses. The landing error is corrected by the electrostatic lens formed between the electrodes $G_5$ and $G_6$. In FIG. 3, the potential represented by broken line is that excluding the deflection electric field $\vec{E}$.

Deflection of the electron beam $B_m$ is effected by the deflection electric field $\vec{E}$ according to the electrode $G_4$.

In FIG. 1, the ceramic ring 11 with the conductive part 10 formed on its surface is sealed with the frit 9 at one end of the glass bulb in order to apply the prescribed voltage to the electrode $G_5$. Since machining is required in the glass bulb 1, such construction has problems in the reliability and cost.

As shown in FIG. 4, a ceramic ring 17 with a conductive part formed on its surface may be sealed with frit 18 at the midway point of the glass bulb 1 in order to apply the prescribed voltage to the electrode $G_5$. Or otherwise, although not shown in the figure, the glass bulb may be bored and a metal pin may be inserted and sealed with frit also in order to apply the voltage to the electrode $G_5$. Since such construction also requires maching in the glass bulb, there exist similar disadvantages to those in FIG. 1.

Further, although not shown in the figure, a lead from the electrode $G_6$ may be formed on an inner surface of the glass bulb across the electrode $G_4$ so that the prescribed voltage is applied to the electrode $G_5$ through the stem pin, the contactor spring and the lead, or resistance films may be formed between the electrodes $G_4$ and $G_5$ and between the electrodes $G_5$ and $G_6$ so that the prescribed voltage is applied to the electrode $G_5$ by means of resistance dividing. However, such construction is difficult to machine and has problems of accuracy.

SUMMARY OF THE INVENTION

In view of such disadvantages in the prior art, an object of the invention is to provide a cathode ray tube which has no problem of reliability, accuracy and which cost and can be manufactured easily.

In order to attain the above object, a cathode ray tube of the invention comprises a first electrode to which low potential is applied and a second electrode to which high potential is applied, the first and second electrodes being combined with each other in zigzag form at intermediate positions, and an electro-optical system formed at the intermediate position has intermediate potential between the low potential and the high potential.

In the above-mentioned S·S type image pickup tube, for example, if the electrode $G_4$ and the electrode $G_6$ are combined in zigzag form at the region of the electrode $G_5$, the region is supplied with potential as if the electrode $G_5$ exists and therefore the electrode $G_5$ may be omitted. Consequently, although the glass bulb must be machined or the lead or the resistance film must be formed so as to apply the prescribed potential to the electrode $G_5$ in the prior art, the need of such process may be entirely obviated in the present invention and problems in the reliability, accuracy and cost associated with such process may be eliminated and moreover the manufacturing becomes easy.

DESCRIPTION OF THE PREFERRED EMBODIMENTS

Figure 1:
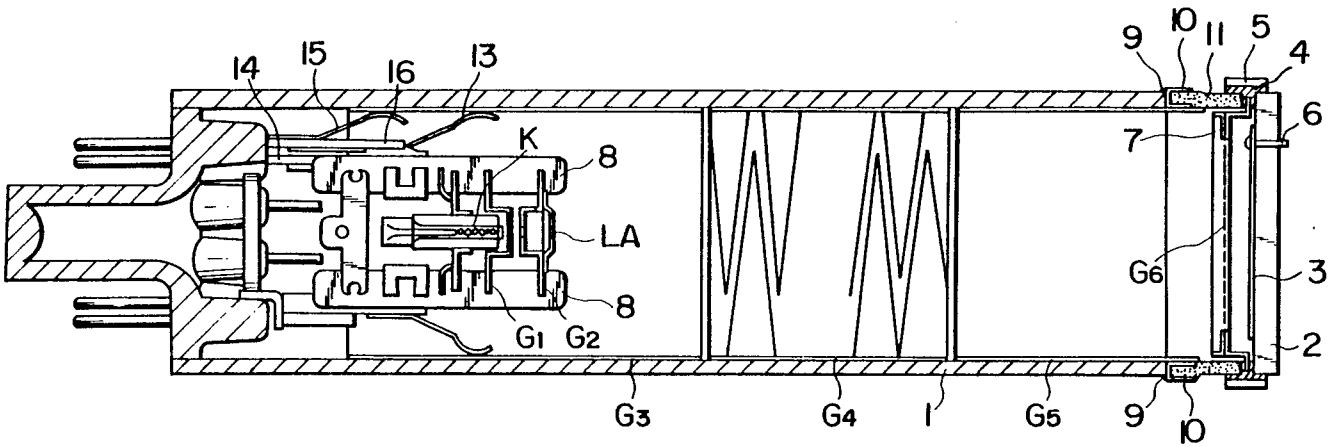
FIG. 1 PRIOR ART
FIG. 1 is a sectional view of an example of an image pickup tube in the prior art.
Figure 2:
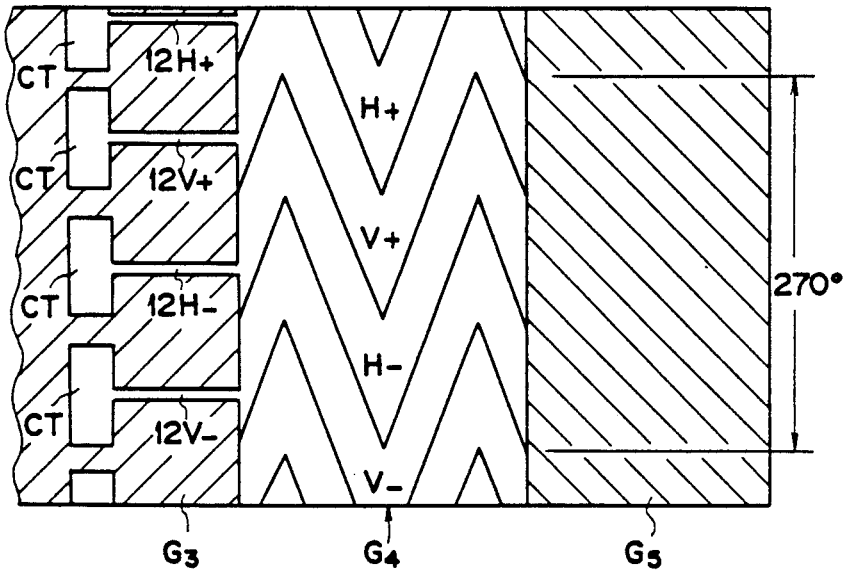
FIG. 2 is a development of essential part in FIG. 1.
Figure 3:
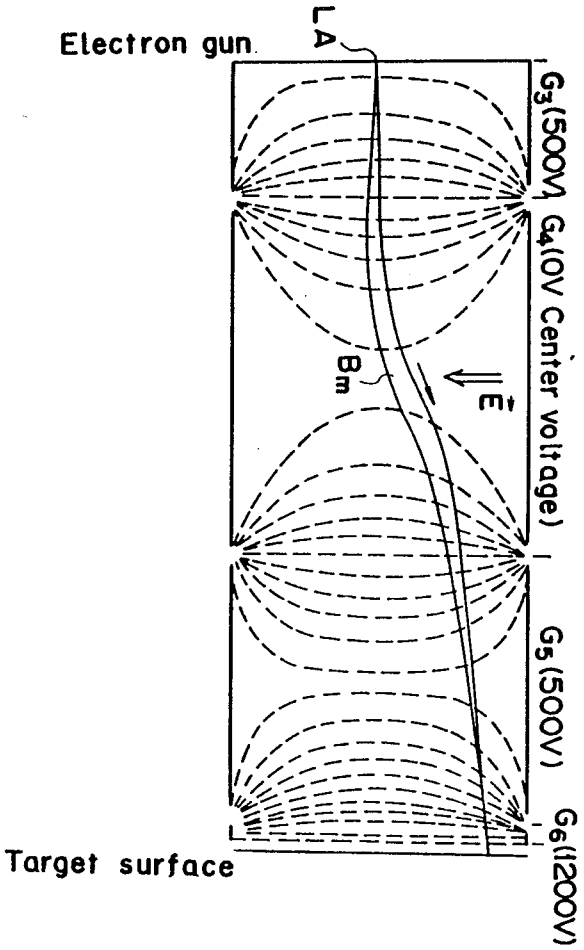
FIG. 3 PRIOR ART
FIG. 3 is a diagram illustrating potential distribution in FIG. 1.
Figure 4:
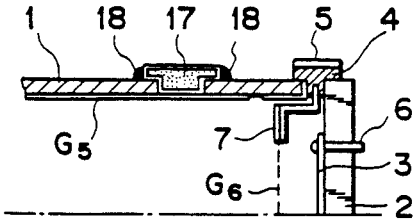
FIG. 4 PRIOR ART
FIG. 4 is a sectional view of partial modification in FIG. 1.
Figure 5:
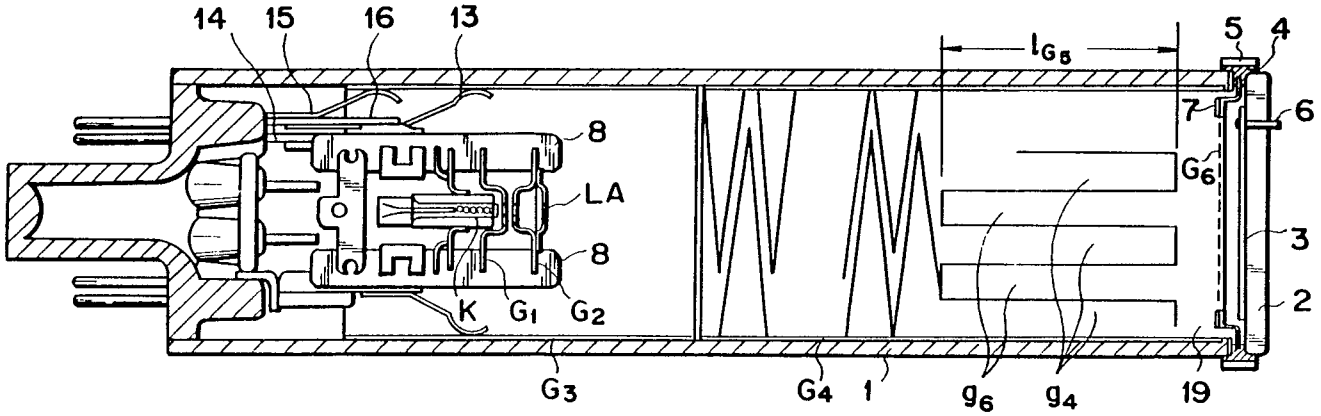
FIG. 5 is a sectional view of an embodiment of the invention.
Figure 6:
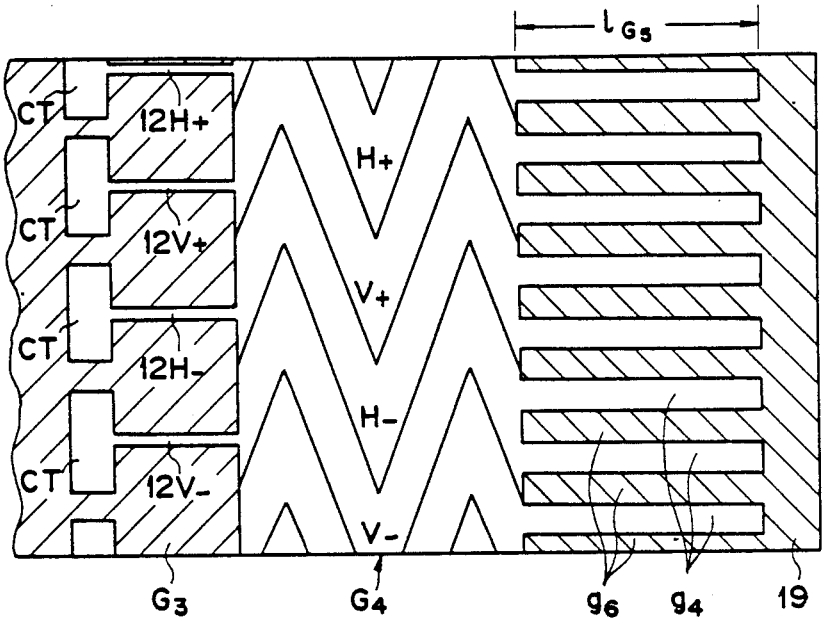
FIG. 6 is a development of essential part of the embodiment in FIG. 5.

An embodiment of the invention will now be described referring to FIG. 5 and FIG. 6. In FIG. 5 and FIG. 6, parts corresponding to FIG. 1 and FIG. 2 are designated by the same numerals and the detailed description shall be omitted.

In the embodiment, no electrode $G_5$ is formed between the electrode $G_4$ and the electrode $G_6$. Extensions of the electrodes $G_4$ and $G_6$ are combined with each other in zigzag form at region $l_{G5}$ where the electrode $G_5$ is to be formed, and the region $l_{G5}$ is supplied with potential as if the electrode $G_5$ exists there.

In FIG. 5, numeral 19 designates an electrode connected to the mesh electrode $G_6$. Symbol $g_4$ designates a comb-like extension from the electrode $G_4$, and symbol $g_6$ designates a comb-like extension from the electrode 19. The extensions $g_4$ and $g_6$ are combined with each other in zigzag form at the region $l_{G5}$ where the electrode $G_5$ is to be formed. The electrode 19 and the extensions $g_4$, $g_6$ are made in a similar process to the electrodes $G_3$, $G_4$ in which metal such as chromium or aluminum is evaporated or plated on the inner surface of the glass bulb 1 and then prescribed patterns are formed by cutting using a laser, photoetching or the like.

FIG. 6 is a development showing the electrodes $G_3$, $G_4$ and 19.

In this case, if the total area of the extensions $g_4$ of the electrode $G_4$ is represented by $a_4$ and the total area of the extensions $g_6$ of the electrode 19 is represented by $a_6$, the areas $a_4$ and $a_6$ are formed so as to satisfy the following formula.

$$E_{G5} = E_{G4} \times \frac{a_4}{a_6 + a_4} + E_{G6} \times \frac{a_6}{a_6 + a_4} \quad (1)$$

In formula (1), $E_{G4}$: center potential of the electrode $G_4$, $E_{G6}$: potential of the electrode $G_6$, $E_{G5}$: potential to be applied to the region $l_{G5}$.

For example, if $E_{G4}=0V$, $E_{G6}=1200$ V and $E_{G5}=500$ V, the area ratio of $a_4$ in 58% and $a_6$ is 42% is formed at the region $l_{G5}$.

Since the deflection voltage is applied to each of the electrode portions $H_+$-$V_-$ of the electrode $G_4$, the extension $g_4$ is also supplied with the deflection voltage. However, since the potential $E_{G5}$ of the region $l_{G5}$ is high and speed of the electron beam $B_m$ is rapid at the region $l_{G5}$, there is little influence of the deflection voltage.

The embodiment is constructed in similar manner to FIG. 1 except for the above description.

In the embodiment, although the electrode $G_5$ is not formed, the region $l_{G5}$ where the electrode $G_5$ is to be formed is supplied with potential as if the electrode $G_5$ exists. Consequently, the embodiment acts in similar manner to FIG. 1.

In the embodiment, since the electrode $G_5$ need not be formed, the necessary of voltage application to the electrode $G_5$ is obviated. Although the glass bulb must be machined or the lead or the resistance film must be formed so as to apply the prescribed voltage to the electrode $G_5$ in the prior art, the need of such process may be entirely obviated in the embodiment and problems in the reliability, accuracy and cost associated with such process may be eliminated and moreover the manufacturing becomes easy.

Figure 7:
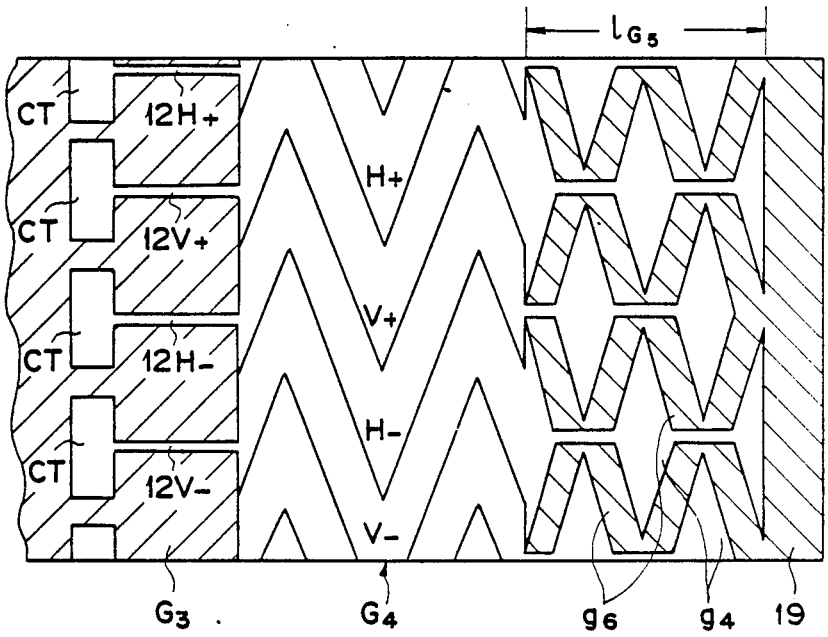
FIG. 7 is a development of essential part of another embodiment of the invention.
Figure 8:
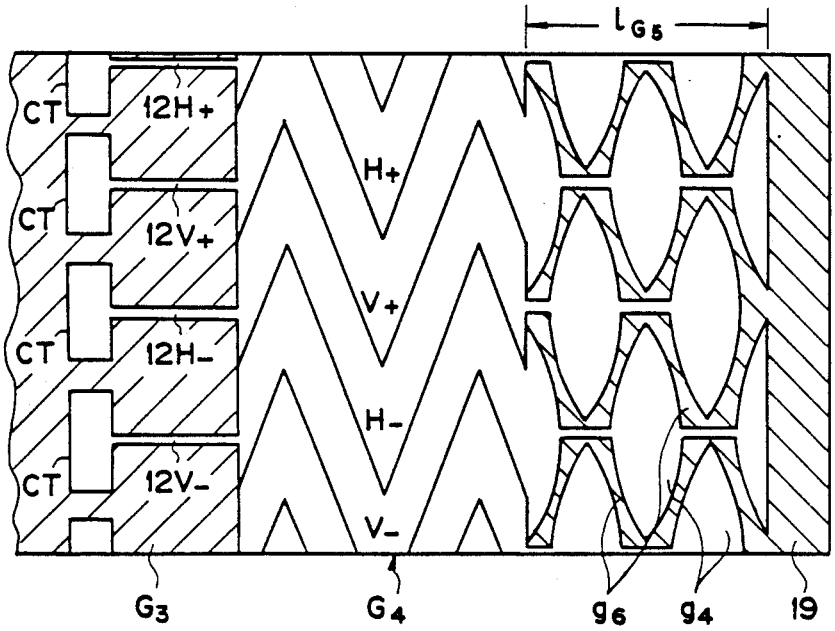
FIG. 8 is a development of essential part of a further embodiment of the invention.
Figure 9:
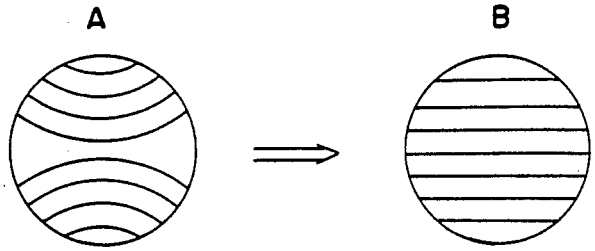
FIG. 9 is a diagram illustrating the embodiments in FIGS. 7 and 8.

FIG. 7 and FIG. 8 show other embodiments of the invention, and the extensions $g_4$ of the electrode $G_4$ corresponding to the electrode portions $H_+$-$V_-$ of the electrode $G_4$ are formed in rhombic continuous patterns and leaf-like patterns, respectively. Since the extensions $g_4$ are made in patterns as shown in FIG. 7 and FIG. 8, the deflection electric field according to the deflection voltage applied to the extensions $g_4$ can be converted from that shown in FIG. 9A into that shown in FIG. 9B where the uniform field is formed without distorsion. Consequently, formation of the patterns shown in FIG. 7 and FIG. 8 can reduce the influence of the deflection voltage applied to the extensions $g_4$, that is, the deterioration of characteristics. In this case, too, the areas $a_4$, $a_6$ of the extensions $g_4$, $g_6$ are formed so as to satisfy the above formula (1).

Figure 10:
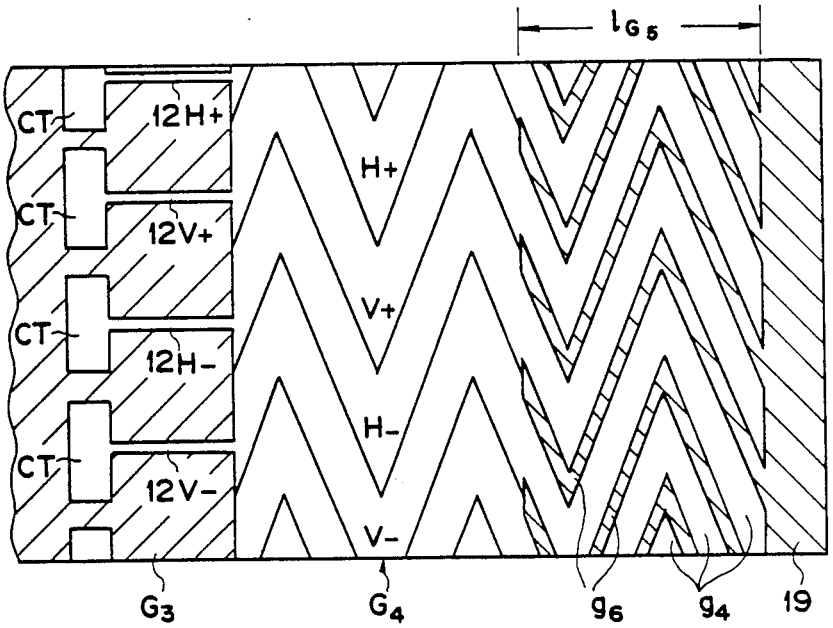
FIG. 10 is a development of essential part of still another embodiment of the invention.

FIG. 10 shows still another embodiment of the invention, where the extensions $g_4$ of the electrode $G_4$ are formed in so-called arrow patterns. When the extensions $g_4$ are formed in such patterns, the deflection electric field according to the deflection voltage applied to the extensions $g_4$ becomes uniform without distorsion in similar manner to FIG. 7 and FIG. 8. In this case, too, the areas $a_4$, $a_6$ of the extensions $g_4$, $g_6$ are formed so as to satisfy the above formula (1).

Although the electrodes $G_3$, $G_4$ and 19 are adhered and formed on the inner surface of the glass bulb 1 in the above embodiments, the invention can be applied also to electrodes formed by a metal plate, for example. Further, although the above embodiments disclose application of the invention to an image pickup tube of the S·S type, the invention may be applied also to cathode ray tubes such as a storage tube or a scan converter.

According to the invention as clearly seen in the above embodiments, since the electrode $G_5$ need not be formed in the S·S type image pickup tube for example, the necessity of voltage application to the electrode $G_5$ may be obviated. Consequently, although the glass bulb must be machined or the lead or the resistance film must be formed so as to apply the prescribed voltage to the electrode $G_5$ in the prior art, the need of such process may be entirely obviated in the invention and problems in reliability, accuracy and cost associated with such process may be eliminated and moreover the manufacturing becomes easy.

What is claimed is:

1. An electron lens system for a cathode ray tube comprising: an envelope, an electron beam source positioned at one end of said envelope, a target positioned at the other end of said envelope, a first electrode which is supplied with a first potential and positioned between said electron beam source and said target, a second electrode which is supplied with a second potential which is higher than said first potential and which is positioned between said electron beam source and said target, and third electrodes which are separated along the direction of electron beam and are formed as four part electrodes and which are supplied with vertical or horizontal deflection voltage and which are all positioned between first and second electrodes, first extensions from said first electrode to each of said third electrodes and second extensions from each of said third electrodes to said first electrode interlaced with each other and electrically isolated from each other at a position which is intermediate between the first and third electrodes, and third extensions from each of said third electrodes to said second electrode and fourth extensions from said second electrode to each of said third electrodes and interlaced with each other and electrically isolated from each other at a position which is intermediate between the second and third electrodes, whereby an intermediate potential is used for a focussing lens between said second potential and said third potential exists at said intermediate position which is a function of the area of said second and third extensions.

2. A cathode ray tube according to claim 1, wherein said first electrode, said second electrode and extensions of both electrodes are formed on an inner surface of said envelope.

3. A cathode ray tube according to claim 2, wherein the extensions from said first electrode comprise an area defined by a plurality of straight lines parallel with the axis of said envelope.

4. A cathode ray tube according to claim 2, wherein the extensions from said first electrode are formed in rhombic or leaf-like patterns.

5. A cathode ray tube according to claim 2, wherein the extensions from said first electrode are formed in arrow patterns.

* * * * *